US008630437B2

(12) United States Patent
Pandey et al.

(10) Patent No.: US 8,630,437 B2
(45) Date of Patent: Jan. 14, 2014

(54) OFFENDING FREQUENCY SUPPRESSION IN HEARING AIDS

(75) Inventors: Ashutosh Pandey, Salt Lake City, UT (US); V. John Mathews, Salt Lake City, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 401 days.

(21) Appl. No.: 13/031,943

(22) Filed: Feb. 22, 2011

(65) Prior Publication Data

US 2011/0206226 A1 Aug. 25, 2011

Related U.S. Application Data

(60) Provisional application No. 61/307,257, filed on Feb. 23, 2010.

(51) Int. Cl.
*H04R 25/00* (2006.01)

(52) U.S. Cl.
USPC ..... 381/381; 381/317

(58) Field of Classification Search
USPC ..... 381/312, 317, 318
See application file for complete search history.

(56) References Cited

U.S. PATENT DOCUMENTS

| | | | | |
|---|---|---|---|---|
| 4,658,426 | A | 4/1987 | Chabries et al. | |
| 5,091,952 | A | 2/1992 | Williamson et al. | |
| 5,999,631 | A | 12/1999 | Porayath et al. | |
| 6,069,960 | A * | 5/2000 | Mizukami et al. | 381/74 |
| 6,831,986 | B2 | 12/2004 | Kates | |
| 7,024,011 | B1 | 4/2006 | Hamacher et al. | |
| 7,050,966 | B2 | 5/2006 | Schneider et al. | |
| 7,110,554 | B2 | 9/2006 | Brennan et al. | |
| 7,227,959 | B2 | 6/2007 | Abraham | |
| 7,292,699 | B2 | 11/2007 | Gao et al. | |
| 7,477,754 | B2 | 1/2009 | Rasmussen et al. | |
| 7,639,827 | B2 | 12/2009 | Bächler | |
| 7,650,005 | B2 | 1/2010 | Chalupper | |
| 2006/0093173 | A1 * | 5/2006 | Hamacher et al. | 381/317 |
| 2006/0215852 | A1 | 9/2006 | Troxel | |
| 2009/0028366 | A1 | 1/2009 | Tklinkby | |
| 2009/0245552 | A1 | 10/2009 | Salvetti | |

* cited by examiner

*Primary Examiner* — Brian Ensey
(74) *Attorney, Agent, or Firm* — Fulbright & Jaworski LLP

(57) ABSTRACT

Adaptive notch filters can be used to estimate offending frequencies caused by feedback within a hearing aid system. The offending frequencies can be suppressed by filtering. Offending frequencies can be identified based on variability of the adaptive notch filter parameters.

21 Claims, 2 Drawing Sheets

OFFENDING FREQUENCY SUPPRESSION IN HEARING AIDS

This application claims the benefit of U.S. Provisional Patent Application Ser. No. 61/307,257, filed on Feb. 23, 2010, which is herein incorporated by reference.

FIELD

The present application relates to hearing aids. More particularly, the present application relates to suppression of acoustic feedback in hearing aids.

BACKGROUND

Hearing aids have been of great to benefit to individuals with hearing loss. A typical hearing aid includes: one or more microphones to pick up incoming audio sound (acoustic energy), an amplifier, and a speaker positioned to allow delivering an amplified acoustic signal into the user's ear. Unfortunately, feedback of the amplified acoustic signal back into the microphone can cause undesirable effects such as ringing or howling. The maximum amplification that can be provided by the hearing aid is typically limited by this feedback.

Various techniques have been applied to attempt to reduce problems caused by feedback to allow increased amplification. While, these techniques have provided varying success, as hearing aids are made smaller, problems caused by feedback have become increasingly challenging. In particular, as a hearing aid is made smaller, not only can the amount of acoustic feedback increase, but a smaller delay is present in the feedback path. The reduced delay and increased feedback can result in oscillation building to unacceptable levels much more quickly.

SUMMARY

In some embodiments of the invention, a hearing aid device is disclosed. The hearing aid device can include a microphone, an amplifier, and a speaker. The microphone can convert an acoustic input signal into an output electronic signal and the speaker can convert an input electronic signal into an output acoustic signal. The amplifier can be inserted between the microphone output and the speaker input. An equalization filter can be inserted between the microphone and the amplifier and can filter the output signal of the microphone. An adaptive notch filter can identify an offending frequency and provide a filter characteristic for the equalization filter to suppress the offending frequency. The adaptive notch filter can process either the output signal of the microphone or the output of the equalization filter to identify the offending frequency.

In some embodiments of the invention, an integrated circuit device for suppression of offending frequencies in a hearing aid system is provided. The integrated circuit device can include a microphone input and a speaker output coupled to the microphone input via a signal path. Disposed within the signal path can be an amplifier and an equalization filter. The amplifier can amplify a signal present in the signal path. The equalization filter can be programmable to suppress at least one offending frequency of the signal present in the signal path. An adaptive notch filter can be coupled to the signal path and configured to estimate an offending frequency present within the signal path and provide the offending frequency to the equalization filter.

In some embodiments of the invention, a method of suppressing feedback in a hearing aid device is disclosed. The method can include converting an acoustic input into an electronic signal. The method can also include converting an amplified and filtered version of the electronic signal into an acoustic output. Another operation in the method can be performing an adaptive notch filtering operation on either the electronic signal or the amplified filtered version of the electronic signal to identify an offending frequency present in the electronic signal. Also included in the method can be filtering the electronic signal to suppress the offending frequency.

BRIEF DESCRIPTION OF THE DRAWINGS

Additional features and advantages of the invention will be apparent from the detailed description that follows, taken in conjunction with the accompanying drawings, that together illustrate, by way of example, features of the invention; and, wherein.

DETAILED DESCRIPTION

Figure 1:
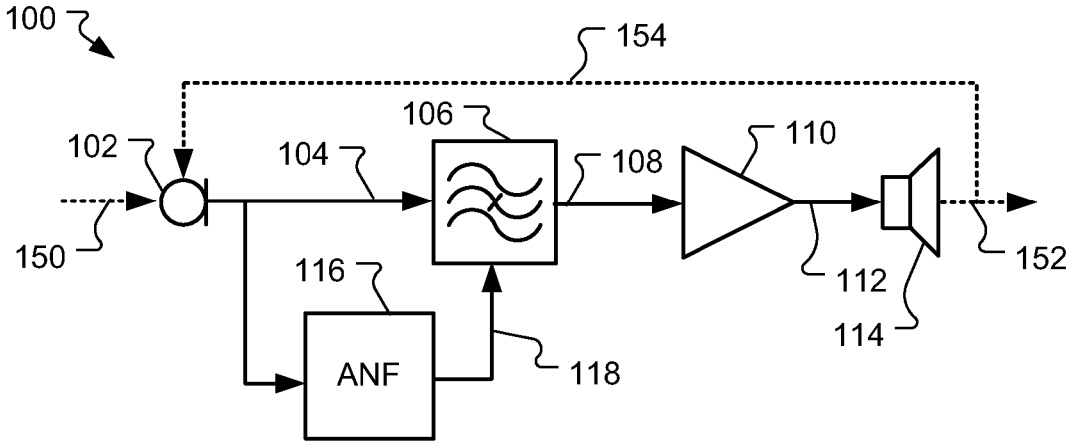
FIG. 1 is a block diagram of a hearing aid system in accordance with some embodiments of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

In describing the present invention, the following terminology will be used:

The singular forms "a," "an," and "the" include plural referents unless the context clearly dictates otherwise. Thus, for example, reference to a microphone or filter includes reference to one or more of such microphones or filters.

As used herein, the term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art.

By the term "substantially" is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all the individual numerical values or sub-ranges encompassed within that range as if each numerical value and sub-range is explicitly recited. As an illustration, a numerical range of "about 1 to 5" should be interpreted to include not only the explicitly recited values of about 1 to 5, but also include individual values and sub-ranges within the indicated range. Thus, included in this numerical range are individual values such as 2, 3, and 4 and sub-ranges such as 1-3, 2-4, and 3-5, etc. This same principle applies to ranges reciting only one numerical value and should apply regardless of the breadth of the range or the characteristics being described.

As used herein, a plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items unless the context clearly dictates otherwise.

As used herein, the term "alternatively" refers to selection of one of two or more alternatives, and is not intended to limit the selection to only those listed alternatives nor is it intended to limit selection to only one of the alternatives at a time, unless the context clearly indicates otherwise.

Turning to the present invention, FIG. 1 illustrates a block diagram of a hearing aid system in accordance with some embodiments of the present invention. The hearing aid system, shown generally at 100, can include a microphone 102, amplifier 110, and speaker 114. The microphone can be a transducer which responds to acoustic signals 150, 154 and provides an electronic output signal 104. The speaker can be transducer which responds to an electrical signal to produce an acoustic output signal 152. Various types of microphones and speakers are known which are suitable for use in a hearing aid, and thus the microphone and microphone need not be described further. The hearing aid system can also include an equalization filter 106, which is described in further detail below. The filter can process the microphone output to provide filtered output 108. An adaptive notch filter 116 can provide filter characteristics 118 to the equalization filter. Examples of embodiments of an adaptive notch filter are described in further detail below.

The forward path of the hearing aid system 100 can thus operate as follows. Acoustic input signals 150 (e.g., desired input audio signals plus feedback 154) can be converted by the microphone 102 into the microphone output 104, which can be filtered by equalization filter 106 to provide filtered signal 108, amplified by the amplifier 110 to provide an amplified signal 112, and the amplified signal converted by the speaker 114 into an acoustic output signal 152. One or more feedback paths 154 can result in portions of the acoustic output signal 152 also being received at the microphone 102. For example, feedback paths can include any one or more of: mechanical conduction of acoustic energy through the body of the hearing aid or user, propagation of acoustic energy from the speaker to the microphone, and reflection of energy from the speaker to the microphone from objects near the hearing aid system. Multiple feedback paths can exist, and the feedback paths can each have a unique transfer function (e.g., differing attenuation and delay as a function of frequency), and the transfer function can vary with time.

It has been recognized by the present inventors that it would be desirable to suppress feedback at offending frequencies before ringing or oscillation at the offending frequencies becomes objectionable to a user. Offending frequencies are frequencies for which the feedback path results in sufficient gain to cause ringing or oscillation at the offending frequency. For example, an offending frequency can be a frequency for which the feedback is sufficiently in phase with the input signal to cause a gradual buildup of energy at the offending frequency. As another example, an offending frequency can be a frequency for which the feedback is sufficient that any input energy at the offending frequency results in a very slow decay of energy from within the system at the offending frequency even after the input energy is removed.

Offending frequencies behave like tonal signals that can be identified using the adaptive notch filter 116. At high gains, as the hearing aid system nears unstable behavior, the energy in the signal components at and around the offending frequencies generally increases in the forward path of the hearing aid system 100 and can create spectral peaks. Such spectral peaks can be tracked and identified using the adaptive notch filter. In the presence of such spectral peaks, adaptive notch filters will converge to the offending frequencies and stay in their vicinities until the energy in such spectral components reduces. The variability of the coefficients of the adaptive notch filter will generally be small when the system is tracking a strong frequency component and the variability will be high when the input signal does not have strong spectral peaks. Thus, the variability can be used to determine when the adaptive notch filter has successfully adapted to an offending frequency. Although one adaptive notch filter has been shown, multiple adaptive notch filters can operate simultaneously (e.g., in parallel, in series (cascade), and/or operating on different subbands as described in further detail below).

Once an offending frequency has been identified by the adaptive notch filter 116, the equalization filter 106 can be programmed to suppress the offending frequency. Accordingly ringing or oscillation at the offending frequency can be reduced or eliminated. Various parameters of the equalization filter can be controlled in addition to suppression frequency (e.g., filter center frequency), including for example, suppression bandwidth (e.g., filter bandwidth, filter order, and/or quality factor), and suppression depth (e.g., filter order and/or quality factor).

Once an offending frequency has been identified and suppressed, the adaptive notch filter can continue to attempt to adapt and track. Thus additional (e.g., more than one) offending frequencies can be identified. If additional offending frequencies are identified, the equalization filter 106 can also be programmed to suppress the additional offending frequencies. Various types of equalization filters can also be used. For example, the equalization filter can be a series arrangement of one or more programmable filters. As another example, the equalization filter can be a filter with one or more programmable zeros/poles.

The equalization filter 106 can be configured to allow for one or more programmable rejection frequencies in its frequency response, wherein the rejection frequencies are determined by the adaptive notch filter 116. Various other types of equalization filters can also be used, including examples provided further below.

In general, providing a larger number of programmable rejection frequencies in the equalization filter 106 can provide for more effective suppression. It is expected, however, that there can be a point at which increasing the number of rejection frequencies may diminish quality. Accordingly, providing a very large number of rejection frequencies may be uneconomical. As a particular example, using a second infinite impulse response filter to provide each rejection frequency, it is believed that an equalization filter providing a number of rejection frequencies in the range between about 2 to about 12 provides an acceptable range of performance.

Figure 2:
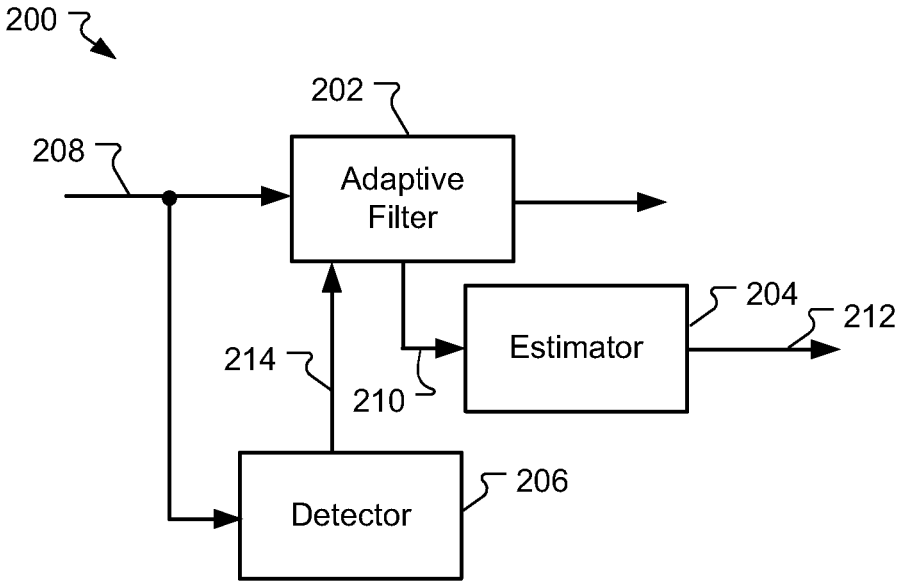
FIG. 2 is a block diagram of an adaptive notch filter in accordance with some embodiments of the present invention.

Turning to operation of the adaptive notch filter 116, various embodiments can be used. FIG. 2 illustrates one example of adaptive notch filter 200 than can be used in some embodiments of the invention. The adaptive notch filter can include an adaptive filter portion 202, an estimator 204, and a detector 206. The adaptive filter portion can operate to identify an offending frequency, the estimator can operate to determine when the adaptive filter portion has successfully identified an offending frequency, and the detector can operator to determine when voice activity or instability is present. If desired, adaptation of the adaptive filter can be selectively controlled (e.g., inhibited or enabled) as a function of voice activity or instability.

The adaptive notch filter 200 can identify and track a dominant spectral component of the input signal. The input 208 to the adaptive filter portion can be at any suitable point within the signal path of the hearing aid system, including for example, at the output of the microphone 102, the output of the equalization filter 106, and the output of the amplifier 110.

The coefficients 210 of the adaptive filter portion 202 can be monitored by the estimator 204. When the adaptive notch filter has locked onto a discrete spectral component, the filter parameters tend to vary little. In contrast, when the filter is not locked onto a discrete spectral component, the filter parameters tend to vary considerably. Accordingly, an offending frequency can be identified by low variation in one or more of the filter parameters. For example, the amount of variation in the filter parameter can be compared to a variability threshold value, and when the variation is less than the threshold, the filter can be considered to have locked onto an offending frequency. The threshold value can be a predefined fixed value, or the threshold value can be operationally determined (e.g., by adaptation).

As a particular example, a parameter for the adaptive notch filter 116 can be a center frequency. The center frequency can be allowed to adapt, and can be monitored. When the center frequency is varying little, an offending frequency can be declared, and filter characteristics 212 can be output (e.g., to the equalization filter 106) for suppression of the offending frequency.

In some embodiments, the adaptive notch filter can be a second order notch filter with a frequency response given by:

$$H_a(z) = \frac{1 - a(n)z^{-1} + z^{-2}}{1 - pa(n)z^{-1} + p^2z^{-2}}$$

The adaptive notch filter can adjust the parameter a(n) to reduce the output power z(n) of the filter. The parameter a(n) can be constrained to adapt between [−1.99, 1.99] to avoid instability. More particularly, the parameter a(n) can be constrained to adapt between $[-2\cos(2\pi f_1/f_s), -2\cos(2\pi f_2/f_s)]$ to track offending frequencies $f_1$ and $f_2$; where $f_s$, is the sampling frequency and frequencies $f_1$ and $f_2$ lie in the operating frequency range $[0, f_s/2]$.

The filtering operation can thus be described by:

$$u(n) = e(n) + pa(n-1)u(n-1) - p^2u(n-2)$$

-continued $$z(n) = u(n) - a(n-1)u(n-1) + u(n-2)$$

$$P_u(n) = \lambda_u P_u(n-1) + (1-\lambda_u)u^2(n-1)$$

$$a(n) = a(n-1) + \frac{\alpha_a}{P_u(n) + \varepsilon_a}u(n-1)z(n)$$

where e(n) is the input to the adaptive notch filter and u(n) is the output from the adaptive notch filter, $\lambda_u$, is a suitable averaging constant, $\alpha_a$ is the step size for adaptation, and $\epsilon_a$ is a small positive constant to help avoid singularities. As described above, the input to the adaptive notch filter can be taken from any suitable point in the signal path. The output of the adaptive notch filter need not be used other than as described above, although if desired the output can be provided to one or more additional adaptive notch filters for detection of multiple offending frequencies simultaneously.

The variability of the parameter a(n) can be determined by the estimator 204 from the (estimated) mean of the past values $a_m$ (n) monitored with a counter $\gamma_a$ (n), according to:

$$a_m(n) = \lambda_m a_m(n-1) + (1-\lambda_m)a(n)$$

$$\gamma_a(n) = \begin{cases} \gamma_a(n-1) + 1; & \text{if } |a(n) - a_m(n)| < \delta_q \\ 0; & \text{otherwise} \end{cases}$$

$$\text{if } \gamma_a(n) > T_a \Rightarrow \text{Offending frequency detected}$$

where $\lambda_m$ is an averaging constant, $\delta_q$ is a change threshold, and $T_a$ is a count threshold. The thresholds can be predefined fixed values or the thresholds can be determined operationally (e.g., by adaptation). Thus, when the adaptive notch filter has locked onto a well-defined frequency component, the frequency can be determined as $$f_p = \frac{1}{2\pi}\cos^{-1}(a(n)/2)$$

The frequency can then be output for loading into the equalization filter 106.

As the system begins to go unstable, energy build-up in the offending frequencies can sound as ringing and deteriorate the output sound quality. The energy in the built-up components at sub-oscillatory stages may, however, be comparable to the tonal components in the audio, and the adaptive notch filter may not track the offending frequencies accurately in such a situation. Removing the incorrectly identified offending frequency could therefore reduce, rather than improve, sound quality.

Consequently, the detector 206 can be employed to determine when to adapt the coefficients of the adaptive filter 202. In particular, the adaptive filter 202 can be selectively updated only during the intervals when no voice activity is detected or when the hearing aid is deemed to be operating in an unstable manner. Updating can be inhibited when voice activity is detected. Control of updating can be provided by an inhibit signal 214 from the detector to the adaptive filter. When there is no acoustic input signal 150 (or a very low level of acoustic input signal) the primary source of input to the microphone can be from the feedback path 154. Hence, any offending frequency that is identified is highly likely to be due to feedback. Conversely, during periods when there is an acoustic input signal present, there is the possibility that the adaptive notch filter will lock onto to a spectral component of the input and incorrectly identify this spectral component as an offending frequency. Thus, suppression of the spectral component could adversely affect the sound quality provided to the user. Accordingly, the adaptation of the adaptive filter can be enabled when the detector detects no voice activity, and disabled when the detector detects voice activity. The detector can determine voice activity as a function of the amount of energy present at the microphone output (e.g., comparison to an energy threshold).

The adaptation of the adaptive filter 202 can also be enabled when there is detection of instability regardless of whether or not there is voice activity. For example, even during periods of no voice activity, feedback may result in oscillation occurring which may result in high levels of energy at the microphone output. Accordingly, adaptation of the adaptive filter can be enabled when the detector 206 detects high level of activity indicative of instability even when there is voice activity. Various approaches for detecting voice activity and instability can be used. One example of a technique of using a short term and long term energy estimate to determine periods of voice activity, non voice activity, and instability will now be described.

The detector 206 can employ a long term energy estimate and a short-term energy estimate obtained using two single pole IIR filters:

$$P_e^l(n)=\lambda_l P_e^l(n-1)+(1-\lambda_l)e^2(n)$$

$$P_e^s(n)=\lambda_s P_e^s(n-1)+(1-\lambda_s)e^2(n)$$

with a long and short time constants, respectively, i.e., $0<\lambda_s<\lambda_l<1$. The system assumes no voice activity if the short term estimate is smaller than a fraction $\delta_v$ of the long term estimate. The system can also assume that the hearing aid is operating in an unstable manner if the long-term estimate exceeds a threshold $T_v$. The threshold can be a predefined fixed value or can be a value determined operationally (e.g., by adaptation).

In some embodiments, the equalization filter 106 can be implemented as a second-order infinite impulse response filter specified by three parameters: center frequency $f_p$, depth of suppression $p<1$ and quality factor q. The parameters p and q can be predefined values, and the center frequency $f_p$ can be determined from the adaptive notch filter as described above. The equalization filter can thus be described in discrete-time domain by the transfer function:

$$H=\frac{b_o+b_1z^{-1}+b_2z^{-2}}{a_o+a_1z^{-1}+a_2z^{-2}}$$

wherein the coefficients can be calculated from parameters p, q and $f_p$ using:

$$K=\tan\left(\frac{2\pi f_p}{f_s}\right)$$

$$\beta=1+K/q+K^2$$

$$b_o=\frac{1+pK/q+K^2}{\beta}$$

$$b_1=\frac{2(K^2-1)}{\beta}$$

$$b_2=\frac{1-pK/q+K^2}{\beta}$$

-continued $$a_0=1$$

$$a_1=\frac{2(K^2-1)}{\beta}$$

$$a_2=\frac{1-K/q+K^2}{\beta}$$

wherein $f_s$ is the sampling frequency.

Various alternate arrangements of a hearing aid system can be used in addition to that shown in FIG. 1. For example, while the adaptive notch filter 118 is shown with its input connected to the output of the microphone 104, this is not essential. The adaptive notch filter can take its input from the output of the equalization filter 106, at the output of the amplifier 110, or anywhere within the signal path between the microphone and the speaker. More than one adaptive notch filter can also be used in a cascade or parallel form to track offending frequencies using the technique described above. Moreover, tracking offending frequencies with an adaptive notch filter can also be used in a subband structure. As another example of an alternate arrangement, the order of the equalization filter and amplifier shown is not essential, and these components can be reverse in order. Accordingly, various other arrangements of a hearing system can be used in accordance with embodiments of the invention, including those described above.

Although not shown in FIG. 1, the signal path can also include other components, such as additional amplifiers, attenuators, compressors, limiters, automatic gain control, decorrelators, analog to digital converters, digital to analog converters, and the like. Furthermore the hearing aid system can also include a conventional adaptive filter which can operate to estimate feedback and cancel the estimated feedback from the signal path.

Figure 3:
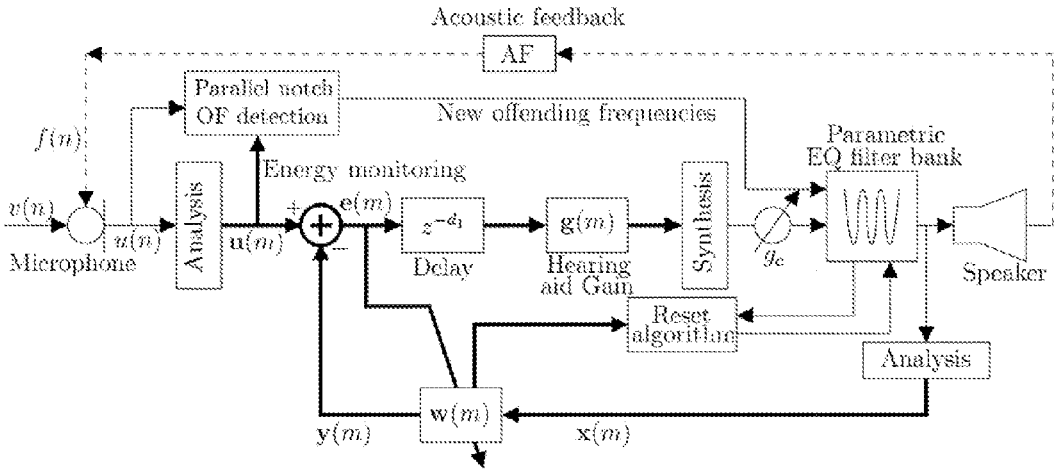
FIG. 3 is a detailed block diagram of another hearing aid system in accordance with some embodiments of the present invention.

For example, FIG. 3 illustrates an example of a hearing aid system which includes a microphone, amplifier (gain), and speaker as in the above example. A parallel notch offending frequency detection block provides offending frequency information to a parametric equalizer bank which suppresses those frequencies. The notch filter and parametric equalizer can operate as described above.

The hearing aid system can also include a decorrelator, shown here in the form of delay. Other types of decorrelators, including for example, probe noise addition, frequency shifting, and continuous phase shifting can be used alternatively to or in addition to the delay. The hearing aid system can also include an adaptive filter to estimate the feedback signal and attempt to cancel (reduce) acoustic feedback by minimizing energy e(m). The decorrelator and adaptive filter can be conventional, and need not be described further. The adaptive filter can also be used to determine when to reset offending frequencies being suppressed by the parametric equalizer as described further below.

In FIG. 3, sub-band processing has been shown, wherein an analysis block can partition the input signal into a plurality of sub-bands, which can be reassembled in a synthesis block. For example, sub-band partitioning and re-assembly can be performed using generalized discrete Fourier transform filter banks. Other transform domains can also be used.

When processing in a sub-band domain, the offending frequencies can be detected independently for each sub-band. Hence, we consider offending frequency detection in the frequency range of the $i^{th}$ sub-band $[f_i^l, f_i^u]$ where $$f_i^l = \frac{2\pi i}{M}$$

is the lower frequency and $$f_i^u = \frac{2\pi(i+1)}{M}$$

is the upper frequency of the band i, i=0 . . . M−1.

The microphone signal energy in band i at time m can be expressed as: $P_i^u = u^T(m)u(m)$ where $u(m)=[u_i(m)\ u_i(m-1) \ldots u_i(m-N_s+1)]$. The relative change in the microphone energy between two successive time intervals can be defined as:

$$P_i^\Delta(m) = \frac{P_i^u(m) - P_i^u(m-1)}{P_i^u(m-1)}$$

The relative change in the microphone energy along with the estimated microphone signal energy $P_i^u(m)$ and the estimated background noise signal power $P_i^b(m)$ can be used by the counter $\gamma_i^r(m)$ to monitor the energy change for the $i^{th}$ sub-band at time m. Larger values of the counter $\gamma_i^r(m)$ implies that the band i is more probable to contain an offending frequency.

The counter can be incremented by $\Gamma_u>0$ to indicate possible howling if the microphone signal $P_i^u(m)$ at time m has sufficient energy (e.g., at least $T_b$ times larger than the background noise power $P_i^b(m)$) and it is greater than or decreased by a small amount $\nu_u$ compared to energy at time m−1, $P_i^b(m-1)$, (i.e. $P_i^\Delta(m)>0$ or $P_i^\Delta(m)<\nu_u<0$). Increase in the microphone energy indicates sustained howling whereas small change in the energy may indicate early stages of howling. On the other hand, the energy growth counter $\gamma_i^r(m)$ can be reduced by an amount $\Gamma_l<0$, if the relative change is smaller than a pre-determined negative constant $V_l$. This is because sudden decrease in the energy is not a characteristic of the acoustic feedback components at the onset of instability. In other situations, where the relative change in energy $P_i^\Delta(m)$ lies between $\nu_l$ and $\nu_u$, the energy growth rate can be modified with a number that is linear interpolation between $\Gamma_l$ and $\Gamma_u$. The amount of change in the energy growth rate value at time m for a given $P_i^\Delta(m)$ is defined by the function:

$$\Phi(P_i^\Delta(m)) = \begin{cases} \Gamma_u; & P_i^\Delta(m) > \nu_u \\ \Gamma_l; & P_i^\Delta(m) < \nu_l \\ \frac{\Gamma_u - \Gamma_l}{\nu_u - \nu_l}(P_i^\Delta(m) - \nu_l + \Gamma_l); & \text{otherwise} \end{cases}$$

The complete energy growth rate calculation is described below. It can be seen that, if the microphone signal $P_i^u(m)$ is sufficiently above (e.g., a background noise threshold $T_b$ times) the noise floor $P_i^b(m)$ and the relative change in energy is positive or close to zero in successive time indexes, the growth rate value $\gamma_i^r(m)$ grows. On the other hand, if it is relatively negative ($P_i^\Delta(m)<\nu_u<0$), the growth rate value will tend to a minimum value $\gamma_i^r$. If the growth rate value $\gamma_i^r(m)$ exceeds a growth threshold $T_\gamma$, one of the two criteria for band i to have an offending frequency is fulfilled. The other criterion can be determined using adaptive notch filters similarly as described above, although with the modification that the parameter $a_i(n)$ can be constrained to adapt between [2 cos ($2\pi f_i^l$), 2 cos($2\pi f_i^u$) to track the frequency range of the $i^{th}$ sub-band [$f_i^l$, $f_i^u$].

Subband offending frequency detection can thus be summarized as follows:

Adaptive notch filter update:

$$s_i(n) = u(n) + pa_i(n-1)s_i(n-1) - p^2 s_i(n-2)$$

$$z_i(n) = s_i(n) + a_i(n-1)s_i(n-1) + s_i(n-2)$$

$$P_i(n) = \lambda_s P_i(n-1) +)1 - \lambda_s s_i^2(n-1)$$

$$a_i(n) = a_i(n-1) + \frac{\alpha_a}{P_i(n) + \varepsilon_a} s_i(n-1) z_i(n)$$

$$a_i(n) = \begin{cases} 2\cos(2\pi f_i^l); & a_i(n) > 2\cos(2\pi f_i^l) \\ 2\cos(2\pi f_i^u); & a_i(n) < 2\cos(2\pi f_i^u) \\ a_i(n); & \text{otherwise} \end{cases}$$

Adaptive notch filter tracking monitor:

$$a_i^m(n) = \lambda_m a_i^m(n-1 + (1-\lambda_m)a_i(n)$$

$$\gamma_i^a(n) = \begin{cases} \gamma_i^a(n-1) + 1; & |a_i(n) - a_i^m(n)| < \delta_q \\ o; & \text{otherwise} \end{cases}$$

Energy growth rate:

$$P_i^u(m) = u^T(m)u(m)$$

$$P_i^b(m) = \min(\delta_b P_i^b(m-1), P_i^u(m)$$

$$\gamma_i^r(m) = \begin{cases} \gamma_i^r(m-1) + \Phi(P_i^\Delta(m)); & P_i^u(m) > T_b P_i^b(m) \\ 0; & \text{otherwise} \end{cases}$$

$$\gamma_i^r(m) = \max(\gamma_i^r(m), \gamma_i^r)$$

Offending frequency detection (when n=Lm):

if $\gamma_i^a(n)>T_a$ and $\gamma_i^r(m)>T_r \Rightarrow$ Offending frequency detected Once the equalization filter 110 (or parametric equalization filter bank) has been programmed to suppress a particular offending frequency, the suppression of that frequency can be maintained indefinitely. For example, such a mode of operating can be beneficial when an offending frequency is the result of mechanical feedback through the body of the hearing aid which is unlikely to change over time. Alternatively, the equalization filter can be programmed to suppress an offending frequency until a predefined event occurs. For example, the predefined event can be the expiration of a timer, a detection of change in the characteristics of the acoustic input signal, a predefined number of additional offending frequency detections occur, or other events. As another alternative, the equalization filter can be programmed so that the suppression of an offending frequency is slowly removed over time. If the offending frequency is still present when the filter has been removed, the adaptive notch filter can readapt to the offending frequency and cause it to be suppressed again. The latter modes of operation can be beneficial when the feedback is subject to change with time. The latter modes of operation can also be beneficial in reducing degradation caused by incorrect identification of tonal inputs as offending frequencies.

In some embodiments, analysis of the adaptive filter coefficients (the adaptive filter shown in FIG. 3) can be used to determine when to reset offending frequencies (i.e., remove the parametric equalizer filters). The can be performed for each subband independently to track the changes in different frequency regions. The reset technique can calculate relative change in the current adaptive filter estimate from older estimates. If the relative change between the current and old estimates is small, it can be assumed there has been no change in the feedback path. Therefore, the previously estimated offending frequencies can be maintained. On the other hand, if the change is larger than a change threshold, the offending frequency can be reset. The change threshold can be a predetermined fixed value or an operationally-determined value (e.g., by adaptation).

The reset algorithm can use two measurements of the adaptive filter coefficients $w_i(m)$. First, a long term average $L_i(m)$ of the adaptive filter coefficients for the $i^{th}$ band at time m can be estimated using a single pole infinite impulse response filter with averaging constant $\lambda_l$, $0<\lambda_l<1$. This can be treated as a measure of the past stable path of the feedback path at time m. A short term average $M_i(m)$ of the adaptive filter coefficients for the $i^{th}$ band at time m can also be estimated with an averaging constant $\lambda_h$ where the averaging constant is such that $0<\lambda_h<\lambda_l<1$. The short term average can be treated as a measure of the current state of the feedback path. If the distance between the short term average differs significantly from the long term average for a few iterations $T_0$, it can be assumed that the feedback path has changed for that band. In this event, parametric equalizer filters that fall in the frequency range of that band can be removed. The calculations can be summarized:

Reset algorithm:

$$L_i(m) = \lambda_l L_i(m-1) + (1-\lambda_l) w_i(m)$$

$$M_i(m) = \lambda_h M_i(m-1) + (1-\lambda_h) w_i(m)$$

$$D_i(m) = L_i(m) - M_i(m)$$

$$\kappa_i(m) = \frac{D_i^T(m) D_i(m)}{L_i^T(m) L_i(m) + \varepsilon_r}$$

$$\gamma_i^o(m) = \begin{cases} \gamma_i^o(m-1)+1; & \kappa_i(m) > \delta_o \\ 0; & \text{otherwise} \end{cases}$$

Detection:

if $\gamma_i^o(n)>T_o \Rightarrow$ remove all parametric EQs between frequencies $f_i^l$ and $f_i^u$ $D_i(m)$ is the distance vector and $\kappa_i(m)$ is the normalized distance between the long term and short term average measurements. The normalized distance $\kappa_i(m)$ remains close to 0 if the feedback path is relatively stationary and increases in magnitude when there are changes in the feedback path. The variable $\gamma_i^o(m)$ counts the number of times the normalized distance has been more than a distance threshold $\delta_o$ to trigger the reset process. The distance threshold can be a predetermined fixed value or can be an operationally-determined value (e.g., by adaptation).

Figure 4:
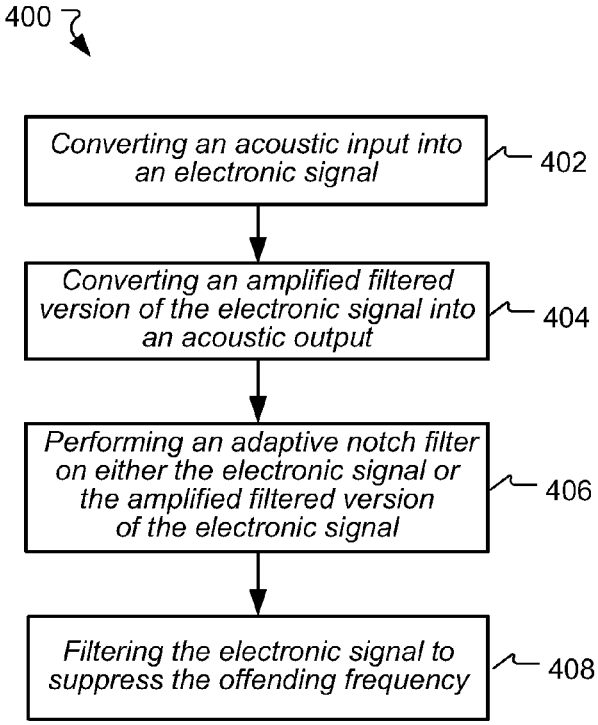
FIG. 4 is a flow chart of a method of suppressing feedback in a hearing aid device in accordance with some embodiments of the present invention.

A method of suppressing offending frequencies in a hearing aid will now be described in conjunction with FIG. 4. The method can be performed, for example, by a system as described above in reference to FIGS. 1 and 2. The method, shown generally at 400, can include converting an acoustic input 402 into an electronic signal. For example, a microphone can provide this capability. Another operation in the method can be converting 404 an amplified filtered version of the electronic signal into an acoustic output. For example, a speaker can provide this capability.

The method can include performing 406 an adaptive notch filter on either the electronic signal or the amplified filtered version of the electronic signal. The adaptive notch filter can identify an offending frequency present in the electronic signal. For example, an offending frequency can be identified when a parameter of the adaptive notch filter has little variation (e.g., as described above). The adaptive filter can perform adaptation when no voice activity is present and not perform adaptation when voice activity is present (e.g., as described above). The adaptive filter can perform adaptation when no voice activity is present and energy indicative of instability is present (e.g., as described as above).

The method can include filtering 408 the electronic signal to suppress the offending frequency. For example, the adaptive filter can provide filter characteristics (e.g., frequencies to be suppressed or nulled) to be used for the filtering 406.

The method can also include other operations, such as for example, converting an analog signal to a digital signal, converting a digital signal to an analog signal, amplifying, attenuating, limiting, compressing, decorrelating, adjusting gain, and the like.

Figure 5:
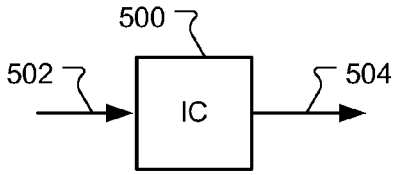
FIG. 5 is a block diagram of an integrated circuit device for suppression of offending frequencies in a hearing aid system in accordance with some embodiments of the present invention.

An integrated circuit device for suppression of offending frequencies in a hearing aid system is illustrated in FIG. 5, in accordance with some embodiments of the present invention. The device, shown generally at 500, can be used, for example, in a system 100 as described above. The device can include a microphone input 502 and a speaker output 504. The microphone input can be, for example, an analog input, in which case the device can include an analog to digital converter. The microphone input can be, for example, a digital input, in which case the device can include a plurality of input lines to receive digital microphone input data and a clock input or output which indicates validity of the digital microphone input data. The speaker output can be an analog output, in which case the device can include a digital to analog converter. The speaker output can be a digital output, in which case the device can include a plurality of output lines to transmit digital speaker output data and a clock input or output which indicates validity of the digital speaker output.

The microphone input 502 can be coupled to the speaker output 504 via a signal path within the integrated circuit. Disposed within the signal path can be an amplifier and an equalization filter. For example, the amplifier and equalization filter can be arranged as described above. The equalization filter can be programmable to suppress at least one offending frequency of the signal present in the signal path. For example, the equalization filter can be as described above. The device can also include an adaptive notch filter coupled to the signal path and configured to estimate an offending frequency present within the signal path. For example, the adaptive notch filter can be as described above. The adaptive notch filter can provide identification of the offending frequency to the equalization filter. The adaptive notch filter can include a detector and estimator, for example as described above.

The device 500 can also include other components such as amplifiers, attenuators, compressors, limiters, automatic gain control, decorrelators, analog to digital converters, digital to analog converters, power supplies, power conditioners, and the like. The device can include analyzers and synthesizers to perform subband processing, for example as described above.

The device 500 can include more than one microphone input 502, more than one speaker output 504, or both, and can perform offending frequency suppression for various combinations of input and output.

While the foregoing examples have shown the adaptive notch filter(s) operating in parallel (i.e., outside the signal path), alternatively the adaptive notch filter(s) can be inserted in-line into the signal path. In such a case, the adaptive notch filter(s) can provide additional cancellation of the offending frequencies.

While various descriptions have been presented in equation form, the processing described herein can be implemented in analog or digital form. For example, processing can be performed in continuous time analog domain using analog components such as operational amplifiers, passive components, transistors, and the like. Processing can alternatively be implemented in discrete time domain using digital signal processors, digital circuits, general purpose signal processors, digital logic circuits, programmable gate arrays, and the like. As another example, processing can be implemented using hybrid combinations of analog and digital, including for example, using analog to digital converters and digital to analog converters for conversion between domains. Accordingly, embodiments of the invention are not limited to any particular digital, analog, or hybrid implementation.

Summarizing and reiterating to some extent, the identification and attenuation of offending frequencies in a hearing aid system can provide for improved performance in some embodiments. For example, in some embodiments, the offending frequencies can be identified during periods of no or little voice activity, helping to avoid suppressing strong spectral components that are present in the desired acoustic input. In some embodiments, identifying the offending frequencies in a separate (not in-line) adaptive notch filter before the offending frequencies are removed by an in-line equalization filter avoids degradation to the acoustic output during time periods the adaptive notch filter is still converging. In some embodiments, only offending frequencies are suppressed, helping to minimize undesirable distortion or coloring of the desired signals. In some embodiments, the offending frequencies can be identified in a sub-oscillatory regime before oscillation or ringing rises to an audible or unacceptable level (e.g., greater than a threshold). In contrast, some prior art techniques can only detect feedback after oscillation has risen to an unacceptable level. In some embodiments, by providing suppression of the offending frequencies, overall gain of the hearing aid system can be increased relative to a system lacking the suppression techniques disclosed herein. In some embodiments, increased gains of 6-8 decibels (dB) over prior art techniques can be achieved. In some embodiments, offending frequencies can also be identified within the low frequency range where most speech energy is present. In contrast, some prior art techniques cannot suppress oscillation at lower frequencies (e.g., less than about 2000 Hertz) without causing unacceptable distortion to voice. Moreover, in some embodiments, the disclosed techniques can allow for elimination of the howling and other types of unstable behavior observed in most hearing aids when operated at high gain levels (e.g. greater than about 45 dB of gain). In some embodiments, the amount of signal processing required to implement the suppression techniques can be relatively moderate, making the techniques applicable to small, lightweight, low power hearing aid devices (e.g., in the ear type hearing aids). In some embodiments, the techniques can be integrated into the signal processing chains of existing hearing aid type devices to provide a performance improvement.

While several illustrative applications have been described, and various benefits of the applications have been disclosed, many other applications of the presently disclosed techniques may prove useful and may provide different or additional benefits. Accordingly, the above-referenced arrangements are illustrative of some applications for the principles of the present invention. It will be apparent to those of ordinary skill in the art that numerous modifications can be made without departing from the principles and concepts of the invention as set forth in the claims.

The invention claimed is:

1. A hearing aid device comprising:

a microphone configured to convert an acoustic input signal into an output signal;

an equalization filter coupled to the microphone, the equalization filter configured to filter the output signal of the microphone to produce a filtered signal;

an amplifier coupled to the equalization filter and configured to amplify the filtered signal to produce an amplified signal;

a speaker coupled to the amplifier and configured to convert the amplified signal into an acoustic output signal; and an adaptive notch filter coupled to the equalization filter and configured to identify an offending frequency and provide a filter characteristic for the equalization filter to suppress the offending frequency by processing any of the output signal of the microphone and the filtered signal, wherein the adaptive notch filter comprises an estimator configured to estimate a variability of an adaptive notch filter parameter, and wherein an offending frequency is identified when the variability is less than a variability threshold value.

2. The device of claim 1, wherein the equalization filter comprises a programmable filter having a plurality of zeros in its frequency response, and wherein frequencies of the zeros are specified by the filter characteristic provided from the adaptive notch filter.

3. The device of claim 1, wherein the equalization filter comprises a plurality of notch filters wherein frequencies for the notch filters are specified by the filter characteristics provided from the adaptive notch filter.

4. The device of claim 1, wherein the adaptive notch filter parameter is a function of the center frequency of the adaptive notch filter.

5. The device of claim 1, wherein the adaptive notch filter comprises a detector configured to detect an activity level at the microphone output.

6. A hearing aid device comprising:

a microphone configured to convert an acoustic input signal into an output signal;

an equalization filter coupled to the microphone, the equalization filter configured to filter the output signal of the microphone to produce a filtered signal;

an amplifier coupled to the equalization filter and configured to amplify the filtered signal to produce an amplified signal;

a speaker coupled to the amplifier and configured to convert the amplified signal into an acoustic output signal; and an adaptive notch filter coupled to the equalization filter and configured to identify an offending frequency and provide a filter characteristic for the equalization filter to suppress the offending frequency by processing any of: the output signal of the microphone and the filtered signal, wherein the adaptive notch filter comprises a detector configured to detect an activity level at the microphone output, and wherein the detector inhibits adaptation of the adaptive notch filter when the activity level indicates voice activity, and enables adaptation of the adaptive notch filter when the activity level indicates no voice activity.

7. The device of claim 5, wherein the detector enables adaptation of the adaptive notch filter when any of (a) the activity level indicates no voice activity and (b) the activity level indicates instability.

8. The device of claim 1, further comprising:

an analyzer configured to general a plurality of sub-bands;

a plurality of adaptive notch filters, each adaptive notch filter operating in a different sub-band.

9. An integrated circuit device for suppression of offending frequencies in a hearing aid system, the device comprising:

a microphone input;

a speaker output coupled to the microphone input via a signal path;

an amplifier disposed within the signal path and configured to amplify a signal present in the signal path;

an equalization filter disposed within the signal path and programmable to suppress at least one offending frequency of the signal present in the signal path; and an adaptive notch filter coupled to the signal path and configured to estimate an offending frequency present within the signal path and provide the offending frequency to the equalization filter, wherein the adaptive notch filter comprises an estimator configured to estimate a variability of a center frequency of the adaptive notch filter, and wherein an offending frequency is identified when the variability is less than a variability threshold value.

10. The integrated circuit device of claim 9, wherein the equalization filter comprises any of: a programmable filter having a plurality of zeros, and a plurality of notch filters having programmable notch frequency.

11. An integrated circuit device for suppression of offending frequencies in a hearing aid system, the device comprising:

a microphone input;

a speaker output coupled to the microphone input via a signal path;

an amplifier disposed within the signal path and configured to amplify a signal present in the signal path;

an equalization filter disposed within the signal path and programmable to suppress at least one offending frequency of the signal present in the signal path; and an adaptive notch filter coupled to the signal path and configured to estimate an offending frequency present within the signal path and provide the offending frequency to the equalization filter wherein the adaptive notch filter comprises a detector coupled to the adaptive notch filter, wherein the detector is configured to detect an activity level at the microphone output, and the detector inhibits adaptation of the adaptive notch filter when the activity level indicates voice activity, and enables adaptation of the adaptive notch filter when the activity level indicates no voice activity.

12. The integrated circuit device of claim 11, wherein the detector further enables adaptation of the adaptive notch filter when the activity level indicates instability.

13. A method of suppressing feedback in a hearing aid device comprising:

converting an acoustic input into an electronic signal;

converting an amplified and filtered version of the electronic signal into an acoustic output;

performing an adaptive notch filtering operation on either the electronic signal or the amplified filtered version of the electronic signal to identify an offending frequency present in the electronic signal; and filtering the electronic signal to suppress the offending frequency, wherein performing an adaptive notch filtering operation on either the electronic signal or the amplified filtered version of the electronic signal to identify an offending frequency present in the electronic signal comprises:

estimating a variability of an adaptive notch filter parameter; and declaring an offending frequency when the variability is less than a variability threshold value.

14. The method of claim 13, further comprising estimating voice activity in the acoustic input.

15. The method of claim 14, wherein estimating voice activity comprises:

forming a short term estimate of energy at the acoustic input;

forming a long term estimate of energy at the acoustic input; and declaring no voice activity when the short term estimate of energy is less than a predefined fraction of the long term estimate of energy.

16. The method of claim 14, wherein adaptation of the adaptive notch filter is suppressed when voice activity is present in the acoustic input and adaptation of the adaptive notch filter is enabled when no voice activity is estimated.

17. The method of claim 14, wherein adaptation of the adaptive notch filter is enabled when either (a) no voice activity is estimated, or (2) instability is estimated.

18. The method of claim 17, wherein estimating excessive activity comprises:

forming a long term estimate of energy at the acoustic input; and declaring instability when the long term estimate of energy is greater than an energy threshold value.

19. The method of claim 17, further comprising:

increasing an energy growth estimator if current acoustic energy is greater than a previous acoustic energy and the acoustic energy is greater than a background noise threshold value;

decreasing an energy growth estimator if current acoustic energy is less than a previous acoustic energy; and declaring instability if the energy growth estimator exceeds a growth threshold value.

20. The method of claim 13, further comprising:

performing an adaptive filter operation on either the electronic signal or the amplified filtered version of the electronic signal to cancel acoustic feedback;

determining a relative change in coefficients of the adaptive filter operation; and resetting the offending frequency when a relative change in the coefficients is greater change than a threshold value.

21. The method of claim 20, wherein determining a relative change in coefficients of the adaptive filter comprises:

forming a long term average of the adaptive filter coefficients;

forming a short term average of the adaptive filter coefficients;

determining a distance between the long term average and the short term average; and using the distance as the relative change.

* * * * *